US005237778A

United States Patent [19]

Baer

[11] Patent Number: 5,237,778

[45] Date of Patent: Aug. 24, 1993

[54] COUNTER-FLOW BUFFER AND CLEANER

[76] Inventor: William F. Baer, 1509 N. Darcy, Simi Valley, Calif. 93065

[21] Appl. No.: 905,995

[22] Filed: Jun. 26, 1992

Related U.S. Application Data

[63] Continuation of Ser. No. 586,881, Sep. 24, 1990, abandoned.

[51] Int. Cl.[5] ..... B24B 31/104

[52] U.S. Cl. ..... 51/163.1; 51/313; 134/118; 134/184

[58] Field of Search ..... 51/163.1, 163.2, 313; 134/117, 118, 184; 366/211, 216

[56] References Cited

U.S. PATENT DOCUMENTS

| | | | |
|---|---|---|---|
| 2,222,777 | 11/1940 | Linke | 51/163.1 |
| 3,113,761 | 12/1963 | Platzman | 134/184 |
| 3,151,846 | 10/1964 | George | 134/184 |
| 3,301,535 | 1/1967 | Brown | 134/184 |
| 3,399,869 | 9/1968 | Lona et al. | 134/184 |
| 4,499,692 | 2/1985 | Balz | 51/163.1 |

*Primary Examiner*—Bruce M. Kisliuk
*Assistant Examiner*—Eileen P. Morgan
*Attorney, Agent, or Firm*—Poms, Smith, Lande & Rose

[57] ABSTRACT

A buffer/cleaner for objects such as jewelry or coins includes a bowl for holding the objects. The bowl also holds a treatment material consisting preferably of a carrier material. The carrier material may be granular, a powder, fibers, etc., and may be pre- or post-treated with a chemical buffing or cleaning agent or abrasive. The bowl is mounted resiliently on a vibrating arm, preferably by using a resilient glue or a resilient insert in a channel separating an upper end of the vibrating arm from a protruding coupling portion on the bowl, into which coupling portion the arm extends. The arm is caused to vibrate by a driver motor, preferably of a pulsed electromagnetic type. When the arm vibrates, the bowl is "whipped," that is, the bowl is both translated and rotated about a resilient pivot point out of phase with the vibrating arm, but at substantially the same frequency. This whipping motion induces a counter-flow of the treatment material in separate regions of the bowl. The particles of the treatment material thus contact the objects to be buffed or cleaned evenly over the surface of the objects as they move along in the counter-flows.

17 Claims, 1 Drawing Sheet

FIG. 1
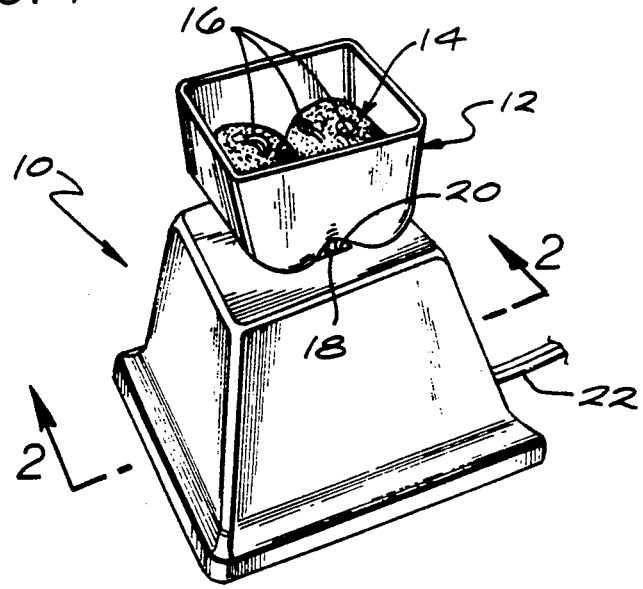
FIG. 3
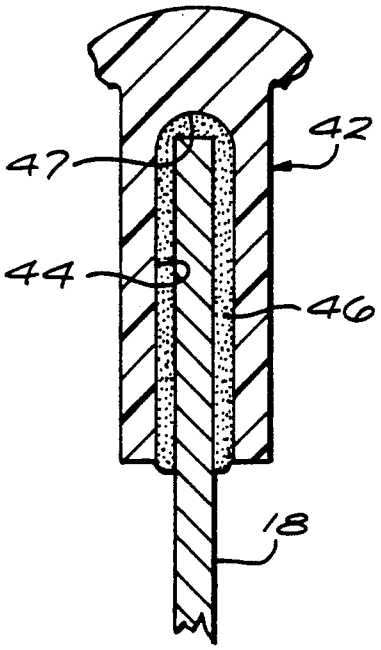
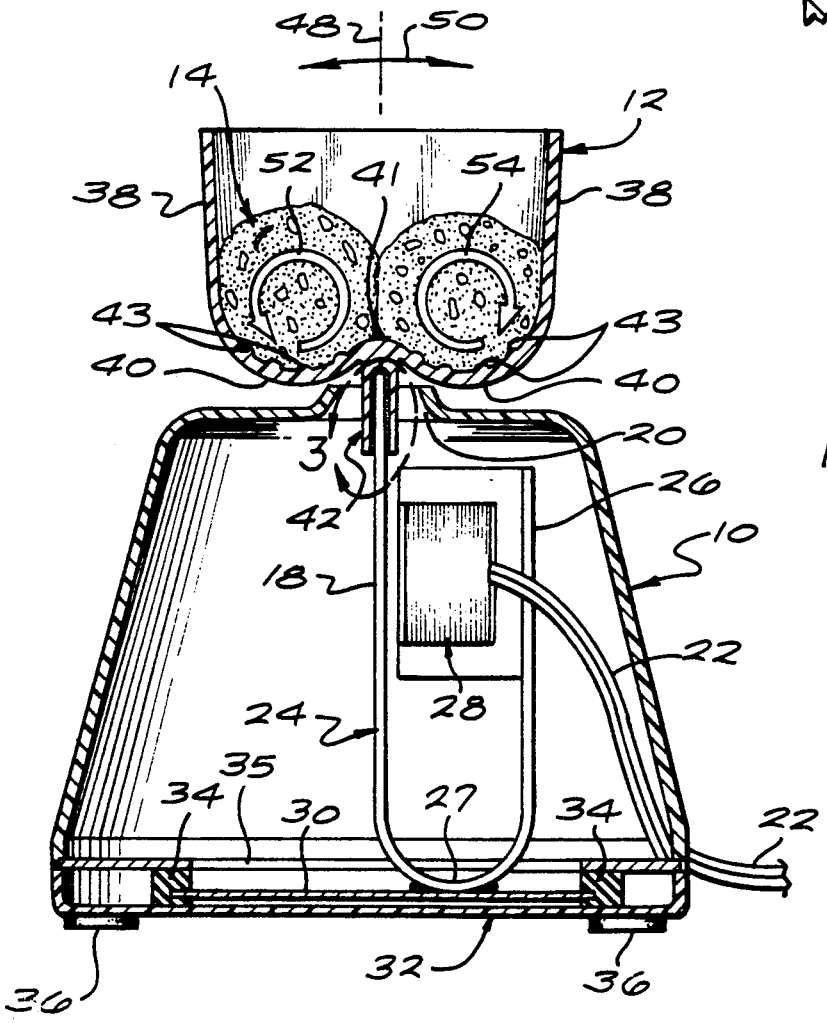
FIG. 2

COUNTER-FLOW BUFFER AND CLEANER

This application is a continuation of now abandoned application, Ser. No. 07/586,881, filed Sep. 24, 1990.

FIELD OF THE INVENTION

This invention relates to a mechanical buffing and cleaning device which uses a treatment material in the form of granules, powder, pellets, fibers, or the like.

BACKGROUND OF THE INVENTION

Buffers and cleaners are often needed in order to clean and polish small objects such as jewelry, coins, etc. There are consequently numerous devices on the market which use buffing wheels or brushes, ultrasound, or chemical cleaners. Such known buffing and cleaning devices suffer from one or more of the following drawbacks: 1) they and/or their buffing and cleaning agents are expensive; 2) they require careful and time-consuming handling and guidance by a human operator; 3) they buff or clean unevenly; 4) they require complicated or specialized parts such as transducers; and 5) they damage the objects to be cleaned or buffed because of too much abrasion or chemical attack.

It is consequently an object of this invention to provide a mechanical device for buffing and cleaning which is inexpensive and easy to operate, yet which buffs and cleans evenly, which is made of easily manufactured and readily available parts, and which avoids the problems of excessive abrasion and chemical attack.

SUMMARY OF THE INVENTION

According to a preferred embodiment of the invention, a buffer/cleaner for objects such as jewelry or coins includes a bowl for holding the objects, a substantially vertically extending vibrating arm, and a driver to cause the arm to vibrate. In the preferred embodiment, the arm may be formed of ferrous material, and the driver is mounted on a mounting arm, whereby the vibrating arm and the mounting arm form two separate, mainly parallel arms of a single bracket formed by bending a strip of metal into a "U" shape.

The bowl also holds a treatment material consisting preferably of a carrier. The carrier may be granular, a powder, fibers, etc., and may be pre-or post-treated with a chemical buffing or cleaning agent or abrasive. The bowl is mounted resiliently on the vibrating arm, preferably by using a resilient glue or a resilient insert in a channel separating an upper end of the vibrating arm from a protruding coupling portion on the bowl, into which coupling portion the arm extends.

In the preferred embodiment, the driver is of a pulsed electromagnetic type. In another embodiment of the invention, the driver includes a breaker contact which is released by contact of the vibrating arm. In yet another embodiment of the invention, the driver is a motor which is mounted directly on the vibrating arm and which induces vibration by turning an eccentric.

When the arm vibrates, the bowl is "whipped," that is, the bowl is both translated and rotated about a resilient pivot point out of phase with the vibrating arm, but at substantially the same frequency. This whipping motion induces a counter-flow of the treatment material in separate regions of the bowl. The particles of the treatment material thus contact the objects to be buffed or cleaned evenly over the surface of the objects as they move along in the counter-flows.

The bowl may have two spaced zones with a ridge extending along the bottom of the bowl generally perpendicular to the direction of movement of the bowl, and with rounded portions of the bowl bottom on either side of the ridge. In operation, the particles of treatment material form counter-rotating cylinders of levitated material on the two sides of the ridge.

BRIEF DESCRIPTION OF THE DRAWINGS

FIG. 1 is a perspective view from above of a preferred embodiment of the buffer/cleaner according to the invention;

FIG. 2 is a cross sectional side view of the buffer/cleaner taken along line 2—2 in FIG. 1; and FIG. 3 is a cross sectional side view of a coupling used in the invention, taken along the line 3 in FIG. 2.

DETAILED DESCRIPTION

This invention is equally useful for buffing, cleaning, polishing, or even deburring small objects such as jewelry, coins, etc. However, for the sake of simplicity only, the invention is referred to below without limitation as the "buffer."

FIG. 1 shows an example of an advantageous embodiment of the buffer according to the invention. As FIG. 1 illustrates, the buffer includes a base housing 10, a bowl 12, and a surface buffing, cleaning, polishing, or deburring material 14. Both the housing 10 and the bowl 12 are preferably made of a hard plastic or rubber material, although other materials are equally useful; the housing and the bowl need not be made of the same material.

Many different materials may be used as the buffing, cleaning, polishing or deburring materials 14. For example, one prototype of the invention used ground walnut shells with a surface coating of chemicals such as gold or silver polish and/or abrasives. The walnut shells thus formed an inexpensive, non-toxic granular carrier for the chemicals and abrasives. Such granular carriers as ground nut shells may be either pre-treated with the polish and/or abrasives, or the chemicals and/or abrasives may be added separately and mixed in with the carriers. Only for the sake of simplicity, all such buffing, cleaning, polishing or deburring materials, including the carrier and any chemical and/or abrasive additives, are referred to collectively below as the treatment material 14.

For buffing, felt mixed with known agents such as cerium oxide is advantageous as the treatment material 14 when the objects to be buffed include glass. Other treatment materials such as Drishine #3, carborundum powder (for deburring), steel shot, etc., may also be used. This invention is not limited to any particular chemical composition for the treatment material 14; many substantially non-sticky, granular, particulate, powdered, fibrous, etc. materials may be used, and the following description of the invention will allow those skilled in the art to chose a treatment material which will enable them to used this invention to advantage. Neither is the invention limited to carrier materials which require separate pre- or post-treatment with a chemical or abrasive buffing agent; rather, the carrier material itself may be sufficiently abrasive or have the chemical properties needed to buff, clean or polish the objects satisfactorily.

In the example shown in FIG. 1, three pieces of jewelry 16 are visible in the bowl, although, as will become apparent below, several more, or fewer, may be in the bowl at the same time. An electrical cord 22 is also shown leading to the base 10 of the buffer.

FIG. 2 is a cross sectional side view of the buffer, taken along line 2—2 in FIG. 1. In the exemplifying embodiment shown, the buffer includes a generally U-shaped bracket 24, with the vibrating arm 18 forming the left arm (viewed as in FIG. 2) of the bracket 24 and with a mounting arm 26 forming the right arm of the bracket 24. In the illustrated preferred embodiment, the mounting arm is substantially parallel to the vibrating arm.

A lower curved portion 27 of the bracket is preferably secured to a mounting plate 30 in the base 10 using any known method such as gluing, soldering, riveting, bolting, etc. The mounting plate 30 is preferably secured by having its corners or edges extend into resilient isolators 34. The isolators 34 are themselves secured, for example, by means of glue, between a base surface 32 of the housing 10 and an inner plate, strips, or wall 35, which extends mainly parallel to the base surface 32. By mounting the bracket 24 on the mounting plate 30 in this manner, raised from the base surface 32 by relilient isolators 34, the tendency of the buffer to "walk" across the surface it stands on is lessened.

If the potential problem of "walking" is not considered severe or is eliminated in some other way, one may alternatively also secure the mounting plate 30 directly on the base surface 32 using, for example, screws, rivets or glue. Yet another possibilty is to secure the bracket 24 itself directly to the base surface 32, although this would mean that much vibrational energy from the bracket would be applied directly to the housing 10 at its base surface 32, and it might further require the base surface to be made thicker or of some other material than the rest of the housing.

Substantially resilient feet 36 are preferably but optionally attached to the housing 10 in order to avoid scratching underlying surfaces and to lessen noise when the buffer is operating.

A vibration driver 28 is mounted on the mounting arm 26. The vibration driver 28 may for example comprise any of a large number of types of known motors which induce the vibrating arm 18 to vibrate. (Viewed as in FIG. 2, in the illustrated example the vibrating arm will vibrate substantially left-right.) In the preferred embodiment shown in FIG. 2, the bracket 24 is manufactured simply and cheaply by bending a generally elongated bar of ferrous metal. In this case the vibration driver 28 may be a pulsed electromagnetic device which attracts the nearby, opposing, ferrous, vibrating arm 18 when pulses of electric current are applied to the driver 28, yet which applies no force to the vibrating arm when the pulses are absent.

Such pulsed drivers are well known and inexpensive, and may be implemented simply using known methods such as including a diode or other half- or full-wave rectifier (not shown) in the power supply to the driver from a normal wall outlet and through the cord 22. For a 60 Hz AC line voltage, the driver will therefore produce sixty electromagnetic pulses per second. Conventional analog or digital devices may optionally be included to allow the operator to vary the pulsation frequency of the driver and thus the vibration frequency of the arm 18. By increasing the power of the electromagnetic pulses, one may increase the amplitude of vibration of the arm 18.

The driver 28 may alternatively be chosen to be a common breaker motor in which a breaker contact is closed when the vibrating arm 18 is not in contact with the breaker. This causes an internal electromagnet to attract the nearby, opposing vibrating arm 18 electromagnetically, but to release the arm 18 when the breaker contact is opened by the vibrating arm 18 contacting the breaker contact. Increasing the distance between the breaker contact and the vibrating arm 18 when at rest (possibly also with an increase in the electromagnetic power of the motor) will then generally increase the amplitude of vibration of the arm 18.

The driver 28 may also comprise a motor mounted, for example, directly on the vibrating arm 18, whereby the motor drives an eccentric in order to cause the arm 18 to vibrate. In this case, the driver 28 may be mounted directly on the vibrating arm 18, so that the mounting arm 26 of the bracket 24 could be left out. A simple potentiometer or other conventional device may then optionally be included to vary the rotational speed of the eccentric and thus the vibration frequency of the arm 18. The vibrating arm 18 may also form part of the driver 28 itself, similar to the hammer arm of a traditional electric door bell, with the bowl attached at the top of the arm.

Furthermore, an optional ON/OFF switch may be included in the buffer for all choices of the driver 28. Such options as speed-control potentiometers, an ON/-OFF switch, etc., will, however, add to the cost of the buffer and are not necessary according to the invention. Neither is it necessary according to the invention for the driver 28 to be supplied with current from an AC net, although this will be the typical method of supplying power. Instead, the driver 28 may be powered by batteries, although the drain on the batteries will normally be so great in all but the smallest applications that the AC net supply will be preferable. With direct current, such as a battery, an interrupter type of circuit would be preferred.

Referring both to FIG. 1 and to FIG. 2, one sees that the bowl 12 in the illustrated preferred embodiment is generally rectangular, with mainly vertical side walls 38. The bottom of the bowl preferably has two substantially cylindrical or rounded recesses 40 on either side of a ridge 41. The bowl also includes a coupling portion 42 into which, in the preferred embodiment, the upper end of the vibrating arm 18 extends and is secured in the manner described below. The vibrating arm 18 thus also supports the bowl 12.

As will become apparent below, the shape of the bowl 12 may be varied, and, although it will normally not be necessary, the bowl may also be provided with a lid. Moreover, it is not necessary that the coupling portion 42 extend within the housing 10, and although the coupling portion is preferably manufactured as a unit with the rest of the bowl 12, it may alternatively be attached, for example by gluing, after the bowl is separately made.

The opening 20 in the housing 10 is large enough that neither the vibrating arm 18 nor any part of the bowl 12 contacts the portion of the housing around the opening 20 when the buffer is working and the arm 18 vibrates. From the description above and especially from FIG. 2, one therefore can understand that the housing 10 serves mainly to enclose the driver 28 and the bracket 24 and to provide a relatively wide and stable base for the buffer, especially when the buffer is to be easily moveable. The general shape of the housing is therefore in no way limited to the shape shown in the figures.

FIG. 3 shows in greater detail the novel coupling between the vibrating arm 18 and the bowl 12 (see FIG. 2). As FIG. 3 illustrates, the upper end of the vibrating arm 18 extends into a channel 44 in the coupling portion 42 of the bowl. Resilient coupling material 46 such as rubber or silicon/rubber glue or an insert made of some resilient material such as a plastic or rubber secures the arm 18 resiliently in the channel 44. The upper end of the arm 18 is therefore able to rotate slightly (i.e., to "wiggle" from side to side) relative to the coupling portion 42 of the bowl. The resilient coupling material 46, in which the upper end of the arm 18 seats, thus provides a damped hinge or pivot point between the vibrating arm 18 and the bowl 12 (FIG. 2), with the innermost edge 47 of the channel 44 (or some portion of the bowl in the vicinity of this edge) acting as a fulcrum.

It is preferable that the coupling portion 42 of the bowl 12 be relatively rigid, since this reduces the risk that the coupling portion will crack or deform under the dynamic stress of vibration. (Recall that the normal frequency of vibration of the arm and bowl will be 60 Hz in North America). However, resilience in the coupling between the arm 18 and the bowl 12 may also be provided wholly or in part by making the coupling portion 42 thinner or in some other way more flexible. In such case, the resilient coupling material 46 may be reduced in thickness or even eliminated.

Referring once again to FIG. 2, assume for the moment that the vibrating arm 18 were rigidly attached to the bowl 12, and assume further that the bowl also was rigid. Under such conditions the bowl 12 would rock back and forth (in FIG. 2, substantially from side to side) with the same frequency and in phase with the vibrating arm 18; furthermore, the buffing material would simply shift back and forth from side to side in the bowl.

However, because of the resilient coupling 42 between the vibrating arm 18 and bowl 12, this does not occur in the arrangements of FIGS. 1–3. Instead, because of the resilience in the coupling, when the arm 18 vibrates, the bowl is "whipped" back and forth. In other words, the bowl 12 is moved out of phase with (but at the same frequency as) the arm 18; furthermore, the bowl not only moves from side to side, it also rotates back and forth about the fulcrum at the frequency of vibration of the arm.

The inventor has discovered that the simultaneous and periodic translational and rotational (that is, "whipping") motions of the bowl set up a counter-flow of the treatment material 14 in the bowl. Viewed as in FIG. 2, an imaginary plane (indicated by a centerline 48) extending mainly vertically, perpendicular to the plane of the figure, and approximately through the fulcrum at the top of the vibrating arm 18, divides the interior of the bowl 12 into left and right regions. When the arm 18 vibrates and the bowl 12 is "whipped" back and forth (as indicated by the double arrow 50), the treatment material in the left region moves or flows in the general counter-clockwise direction indicated by the arrow 52, with the material in the right region moving or flowing in the general clockwise direction indicated by the arrow 54.

As FIG. 2 shows, the bottom 40 of the bowl 12 is preferably also provided with ridges 43, which extend at least part way across the bottom 40 on either side of the central dividing ridge 41. The inventor has discovered that the ridges 43 often lead to increased counterflow of the buffing material in the bowl. The number of ridges 43 provided on the bottom 40 of the bowl may vary and may be chosen by experiment. One should note that the ridges are usually not necessary—even without the ridges 43 a counter-flow is set up for most types of buffing material, so that the ridges 43 may often be excluded in order to lessen the cost of moulding or otherwise making the bowl 12. As FIG. 2 shows, the ridges 43 are generally rounded. The size of the ridges 43 may be varied, and is easily chosen by experimentation.

Although the general directions of particle flow are indicated by the arrows 52, 54, individual particles of the treatment material will tend to move at slightly different speeds. This assures that the treatment material in either region will tend to mix evenly. The treatment material in either region will therefore tend to have relatively uniform "freshness." By shaping the bottom of the bowl 12 with the two rounded recesses 40, there is little "crossover" of particles of treatment material between the two counterflowing regions. The bottom of the bowl may, however, have some other shape; for example, even with a flat-bottomed bowl, the vibration of the arm 18 and the whipping of the bowl set up a counterflow of particles of treatment material. In this case, though, more mixing or crossover (and thus a less well-defined and advantageous counterflow) of particles occurs between the respective regions.

Referring to FIGS. 1 and 2, the objects 16 to be buffed, cleaned or polished are carried along by the treatment material 14 as it flows around in either region of the bowl. As they move, the objects 16 naturally come into contact with and are continuously rubbed by the particles of the treatment material 14. Since the movement is relatively smooth and gentle, several objects 16 may be buffed, cleaned, polishes, etc. in the bowl at the same time with no risk that they will scratch or otherwise damage each other. The relatively random relative movement of the objects 16 and the particles of treatment material ensures even buffing and cleaning of the objects. When the user is satisfied that an object is satisfactorily buffed, cleaned, polished, etc., he simply removes the object from the bowl and allows the remaining objects to continue.

In practical operation, the user simply pours the treatment material 14 into the bowl 12 and plugs in the cord 22 to activate the driver 28 and start the arm 18 and bowl 12 vibrating. He may place the objects 16 to be buffed or cleaned in the bowl either before or after plugging in the buffer, and he may add and remove objects at any time. He may leave the buffer and do something else while the buffer is working, returning only occasionally or after a known buffing period to check whether any object is ready to be removed.

In a working prototype of the invention, the bowl 12 was made of hard rubber and was approximately 2¾ inches square, roughly 1¾ inches deep at the deepest point of the recesses 40, and about 1⅝ inches deep at the shallowest point between the recesses. The coupling portion was approximately ¾ inches long. The housing was roughly 5½ inches square at the base, roughly 3½ inches square at the top, and about 3½ inches high. The vibrating arm was made of a steel strip approximately 1 inch wide and 1/16 inch thick. In actual applications, however, one need of course not follow the dimensions of this prototype.

In the preferred embodiment shown in the figures, the vibrating arm 18 is generally vertical. This is not essential, although tests have shown that this configuration works best to set up a counterflow in the bowl. Instead, for example, the vibrating arm 18 could be mainly horizontal, with the driver 28 mounted to cause the arm to vibrate mainly up-down. In such a configuration, the tip of the vibrating arm 18 would be turned upward to mate with the coupling portion 42 of the bowl. The vibrating arm 18 may also be mounted at other angles.

The resilient coupling between the bowl 12 and the vibrating arm 28 may moreover be otherwise provided. For example, the upper end of the vibrating arm (or a separate bracket) could be bent to conform generally to the bottom wall of the bowl, and could be attached directly to the bottom wall, perhaps with resilient glue. Inertial forces would then in many cases be sufficient to generate the "whipping" motion of the bowl. Further, the bowl could be pivotally mounted on the arm, with only limited pivotal movement being permitted, so that a lost motion effect is achieved of the bowl relative to the outer end of the vibrating arm.

The claims below encompass not only these alternative configurations of the driver and vibrating arm and of the coupling, but also the numerous alternatives described above.

I claim:

1. A device for treating the surface of objects, comprising:

a bowl means for containing both the objects and a treatment material;

a support means for supporting the bowl means;

a resilient coupling means for coupling the bowl means and the support means;

a single driver means for reciprocating the support means and, via the resilient coupling means, for reciprocating the bowl means for inducing counter-flowing currents of the treatment material in the bowl means, said support means further comprising a vibrating arm;

said single driver means alternately attracting and releasing said support means; and said single driver means creating motion of said support means in a first plane, causing said bowl means to move in a direction parallel to the first plane, the inertia of the objects and treatment material within said bowl means causing the objects and treatment material to tend to continue traveling in the same direction after the direction of motion of said support means and bowl means has been reversed, tending to cause objects and treatment material within said bowl means to move in a direction parallel to the first plane and accumulate along the sides of the bowl means located along the first axis, with objects and treatment material within said bowl means tending to migrate away from the point at which said bowl means is coupled to said support means across the top surface of the objects and treatment material with objects and treatment material within said bowl means tending to migrate towards the point at which said bowl means is coupled to said support means across the lower surface of the objects and treatment material and adjacent to said bowl means in which said support means, and vibrating arm further comprise a single member which sets up the counter flowing currents of the treatment material within said bowl means.

2. A device as defined in claim 1, in which the resilient coupling means comprises a coupling portion of the bowl means;

the coupling portion includes a channel for receiving an upper end of the vibrating arm.

3. A device as defined in claim 2, in which the resilient coupling means further includes a resilient coupling material between the upper end of the vibrating arm in the channel and the coupling portion.

4. A device as defined in claim 3, in which the resilient coupling material is a resilient adhesive.

5. A device as defined in claim 3, in which the coupling material includes a resilient insert.

6. A device as defined in claim 1, in which a bottom wall of the bowl means includes two rounded recesses, one located towards each of two opposite ends of the bowl means, one on either side of said support means and along the first axis.

7. A device as defined in claim 1, in which the vibrating arm is made of a strip of ferrous metal, and in which the driver means comprises an electromagnetic circuit for attracting and releasing the vibrating arm at a predetermined frequency.

8. A device as defined in claim 1, in which the support means comprises a generally U-shaped bracket with two substantially parallel arms, one of which is the vibrating arm and the other of which is a mounting arm on which the driver means is mounted, and in which the arms move relative to each other, alternately increasing and decreasing the distance between them.

9. A device as defined in claim 8, in which the two arms of the bracket are substantially vertical.

10. A device as defined in claim 1 in which the bowl is removably attached to said single driver means.

11. A device as defined in claim 1, wherein said support means consists solely of a single vibrating area.

12. A device for treating the surface of objects, comprising:

a bowl for containing both the objects and a treatment material;

support means for supporting the bowl;

a coupling for coupling the bowl and the support to permit movement of the bowl with the support means and rotational movement of the bowl relative to the support;

a single driver for reciprocating the support means in a first plane and, via the coupling, inducing counter flowing currents of the treatment material in the bowl; and in which said support means and driver further comprise a single member which sets up the counter flowing currents of the treatment material within said bowl; said support comprising a single member;

said single driver means creating motion of said support means along a first axis, causing said bowl means to move in a direction parallel to the first axis, the inertia of the objects and treatment material within said bowl means causing the objects and treatment material to tend to continue traveling in the same direction after the direction of motion of said support means and bowl means has been reversed, tending to cause objects and treatment material within said bowl means to move in a direction parallel to the first axis and accumulate along the sides of the bowl means located along the first axis, with objects and treatment material within said bowl means tending to migrate away from the point at which said bowl means is coupled to said support means across the top surface of the objects and treatment material with objects and treatment material within said bowl means tending to migrate towards the point at which said bowl means is coupled to said support means across the lower surface of the objects and treatment material and adjacent to said bowl means.

13. A device as defined in claim 12, in which the support means includes a strip of ferrous metal, and in which the driver comprises an electromagnetic circuit for attracting and releasing the support means.

14. A device as defined in claim 12, in which the support comprises a generally U-shaped bracket with two substantially parallel arms, one of which is the support means and the other of which is a mounting arm on which the driver means is mounted, and in which the arms move relative to each other, alternately increasing and decreasing the distance between the arms.

15. A device as defined in claim 14, in which the two arms of the bracket are substantially vertical.

16. A device as defined in claim 12, in which a bottom wall of the bowl means includes two rounded recesses separated by a ridge, said support means located substantially between said two rounded recesses.

17. A device as defined in claim 12 in which the bowl is removably attached to said single driver means.

* * * * *